United States Patent [19]

Tsubota et al.

[11] 4,356,387

[45] Oct. 26, 1982

[54] APPARATUS FOR COUNTING THE NUMBER OF OBJECTS PASSING A GIVEN POINT

[75] Inventors: Naoki Tsubota; Satoru Shibuya, both of Kyoto, Japan

[73] Assignee: Giken Trading Co., Ltd., Kyoto, Japan

[21] Appl. No.: 47,324

[22] Filed: Jun. 11, 1979

[30] Foreign Application Priority Data

Jul. 21, 1978 [JP] Japan ..... 53-89697

[51] Int. Cl.[3] ..... G07C 9/00

[52] U.S. Cl. ..... 235/92 PK; 235/92 V

[58] Field of Search ..... 235/92 PK, 92 EV, 92 TC, 235/92 V; 250/221, 224

[56] References Cited

U.S. PATENT DOCUMENTS

| | | | |
|---|---|---|---|
| 3,042,303 | 7/1962 | Kendall et al. | 235/92 TC |
| 3,176,267 | 3/1965 | Bolton | 235/92 TC |
| 3,821,558 | 6/1974 | Mansfield | 235/92 V |
| 4,000,400 | 12/1976 | Elder | 235/92 EV |
| 4,009,389 | 2/1977 | Lindholm | 235/92 V |
| 4,127,766 | 11/1978 | Thayer | 235/92 V |
| 4,217,491 | 8/1980 | Dufford et al. | 235/92 V |

*Primary Examiner*—Joseph M. Thesz

*Attorney, Agent, or Firm*—Koda and Androlia

[57] ABSTRACT

An apparatus for counting the number of objects passing a given point which includes a radiant energy emitter provided above a given point, a radiant energy receiver provided above a given point and at an angle to the radiant energy emitter such that a radiant energy beam emitted by the radiant energy emitter intersects an extension of a radiant energy reception path of the radiant energy receiver in an area of intersection located below the emitter and receiver and over said given point and the area of intersection is provided at a height corresponding to the height of an object to be counted and a means coupled to the receiver for counting the number of objects which passes through the area of intersection.

3 Claims, 6 Drawing Figures

APPARATUS FOR COUNTING THE NUMBER OF OBJECTS PASSING A GIVEN POINT

BACKGROUND OF THE INVENTION

1. Field of the Invention

This invention relates to apparatuses for counting the number of objects which pass a given point and particularly relates to apparatuses for counting the number of persons passing through the entrance of a building.

2. Prior Art

In the prior art there exists methods for counting the number of objects which pass a given point and in particular for counting the number of persons which enter a building, etc. through the entrance of the building. Such devices include a light emitter and a light receiver installed so that the light beam emitted by the light emitter is horizontally oriented (i.e., so that the beam is oriented parallel to the floor). As a result, it is not desirable to utilize the above apparatus in such cases.

To overcome the above drawback, another counting apparatus has been developed. Specifically, in such a counting apparatus, a plurality of pairs of light emitters and light receivers are vertically mounted on a ceiling above the entrance of the building so that the light emitters and receiver pairs face the floor. The pairs of light emitters and light receivers are arranged laterally so that they are spaced at intervals corresponding approximately to the width of a person's shoulder. In this manner, two or more persons walking abreast would be counted as individual persons. However, this method leads to additional problems. First of all, all persons passing through the entrance would be counted regardless of differences in body heights, e.g., differences in height between adults and children would be ignored. There are situations, however, where it is desirable to count only the adults, who have the purchasing power. In addition, with the above described apparatus, hand carried luggage, pushcarts and complex movements of the arms and legs are counted as passing persons and the count would bear no relationship to the actual number of persons passing through the entrance.

If the above described apparatus were used and it was desirable to exclude from the count persons under a given body height (e.g. children) hand carried luggage and pushcarts, it would be necessary to adjust the irradiation intensity of the light beams so that persons under a given body height and objects under a similar height would be distinguished and excluded from the count. Such a method, however, would suffer from a drawback in that it would be difficult to maintain the irradiation intensity at a fixed value. For example, the accumulation of dust on the lights during use would alter the irradiation intensity and would require constant cleaning and/or adjustment.

SUMMARY OF THE INVENTION

Accordingly it is the general object of the present invention to provide an apparatus which can distinguish between two persons passing through the entrance of the building at the same time.

It is another object of the present invention to provide an apparatus which can distinguish between persons or objects of different sizes.

It is further an object of the present invention to provide an apparatus for counting persons of different heights which does not require constant adjustment.

In keeping with the principles of the present invention, the objects are accomplished by a unique apparatus for counting the number of objects passing a given point. The apparatus includes a radiant energy emitter provided above a given point, a radiant energy receiver provided above the given point and at an angle to the radiant energy emitter such that a radiant beam emitted by the radiant energy emitter intersects an extension of a radiant energy reception path of the radiant energy receiver in an area of intersection located below the emitter and receiver and over the given point and an apex or low point of the area of intersection is at a height equal to the height of an object to be detected and a means coupled to the receiver for counting the number of objects which passes through the area of intersection.

BRIEF DESCRIPTION OF THE INVENTION

The above mentioned features and objects of the present invention will become more apparent with reference to the following description taken in conjunction with the accompanying drawings wherein like reference numerals denote like elements and in which.

DETAILED DESCRIPTION OF THE INVENTION

Figure 1:
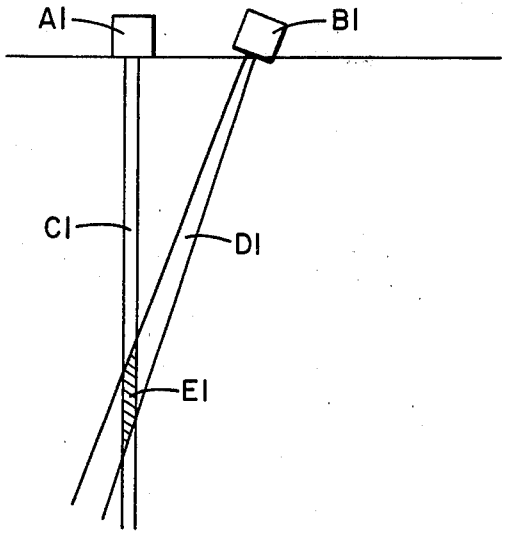
FIG. 1 illustrates the arrangement of a radiant energy emitter and a radiant energy receiver in one embodiment of the present invention for use in building entrances with one-way traffic.

Referring more particularly to the figures, shown in FIG. 1 is the basic arrangement of a single radiant energy emitter-receiver pair utilized in the present invention. In FIG. 1 the radiant energy emitter-receiver pair includes a radiant energy emitter A1 (infrared beam emitter) and receiver energy receiver B1 (infrared beam receiver). The emitter A1 and the receiver beam B1 are installed on the ceiling over a building entrance which is just wide enough for one adult person to pass through at a time. Furthermore, the emitter A1 and receiver B1 are installed so that the receiver B1 faces the emitter A1 at an angle. As a result, the radiant energy beam C1 emitted by the radiant energy emitter A1 intersects an extension D1 of the radiant energy reception path of the radiant energy receiver B1 so that an area of intersection E1 is formed.

The angle between the radiant energy emitter A1 and the radiant energy receiver B1 is adjusted so that the lower end of the area of intersection E1 is some desired value above the floor. The desired value typically is approximately a 120 cm. When one adult person enters the area of intersection E1, the radiant energy beam C1 emitted by the radiant energy emitter A1 is reflected from the head or shoulders of the adult person. This reflector radiant energy is received by the radiant energy receiver B1 and the passing of one person is counted. Furthermore in this embodiment, both entering persons and exiting persons would be counted without any distinction being made between the two categories of passing persons. Therefore, such an apparatus would be appropriate for use in the case of an entrance through which traffic passes in only one direction.

In practice, the radiant energy emitters and receiver, could be infrared type, light type or in some specialized cases microwave type. Furthermore, while the above description has been made in terms of counting people, it would also be possible to adapt this apparatus to count objects of differing heights.

Figure 2:
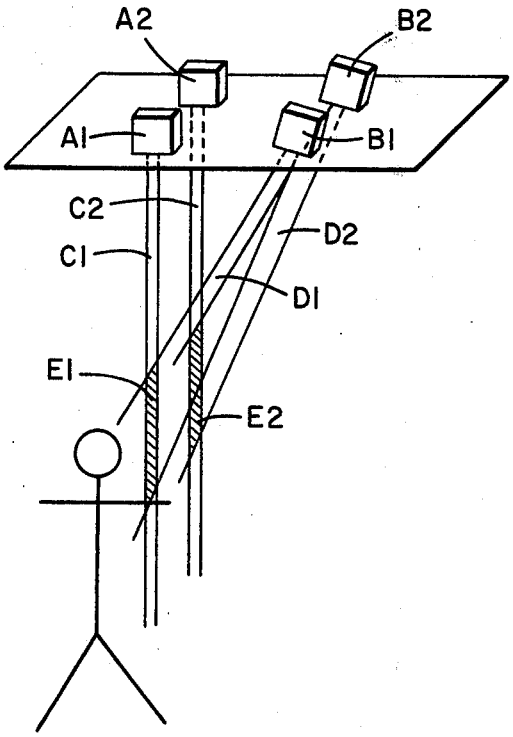
FIG. 2 illustrates the installation of two pairs of radiant energy emitters and radiant energy receivers in two rows in one embodiment of the present invention for use in building entrances with two-way traffic.

Referring to FIG. 2, shown therein is an apparatus which can be utilized in building entrances with two-way traffic. In FIG. 2 the apparatus includes two radiant energy emitters A1 and A2 and two radiant energy receivers B1 and B2. Radiant energy emitter A1 emits radiant energy beam C2. D1 and D2 indicate respectively the extensions of the radiant energy reception paths of the radiant energy receivers B1 and B2 while E1 and E2 indicate the area of intersection respectively between the radiant energy beams C1 and C2 and extensions D1 and D2.

In this arrangement, when one adult person passes through the area of intersection E2 after passing through the area of intersection E1, the person is counted as one person entering. On the other hand, when one adult person passes through the area of intersection E1 after passing through the area of intersection E2, the person is counted as an exiting person. Therefore, this apparatus would be appropriate for use in a case of entrances through which traffic passes in both directions.

Figure 3:
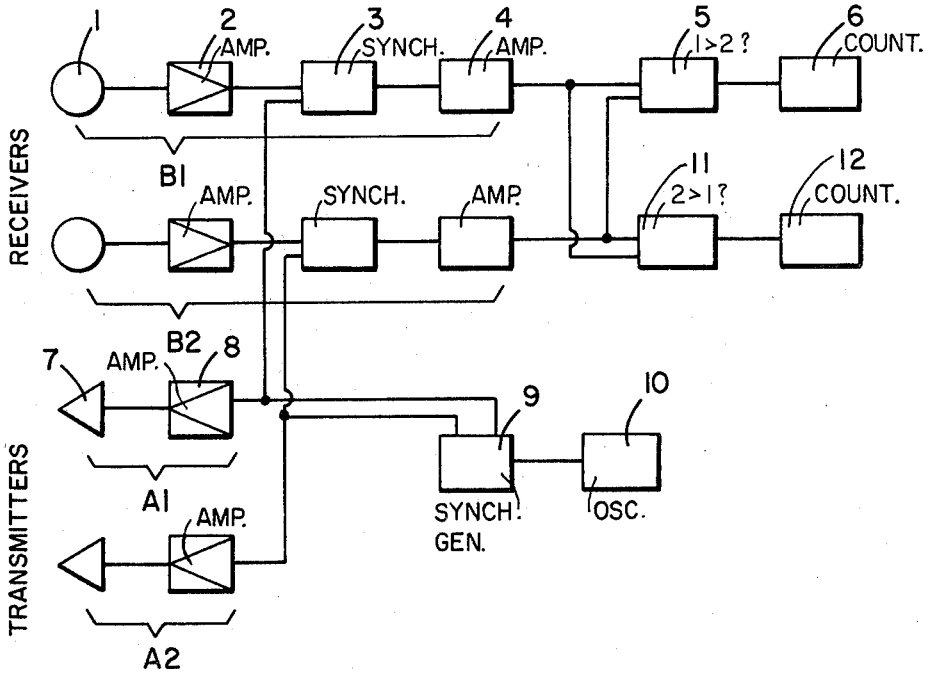
FIG. 3 is a block diagram which illustrates the apparatus for counting both entering and exiting persons using the radiant energy emitters and radiant energy receivers shown in FIG. 2.

Referring to FIG. 3, shown therein is a block diagram which illustrates an apparatus for counting the respective numbers of entering and exiting persons using the radiant energy emitters and receivers shown in FIG. 2. In FIG. 3, the block diagram includes a radiant energy receiving element 1 which has an area of intersection E1 with a radiant emitting element 7. When the head or shoulders of an adult person is present in the area of intersection E1, the radiant energy emitted by the radiant energy element 7 is detected as reflected radiant energy by the radiant energy receiving element 1 and is amplified by the amplifier 2. Next, the product of the amplified radiant energy signal and a synchronizing signal added by a synchronizing detector 3 is obtained and only the synchronized component of the product is extracted as an output. This output is amplified by the amplifier 4. This amplified output constitutes a signal which indicates the presence of the head or shoulders of an adult person in the area of intersection E1. When a signal from the area of intersection E1 preceeds a signal from the area of intersection E2, ordering circuit 5 generates a counting pulse and this pulse is counted by a counter 6 which counts the number of entering persons. The total number of such pulses equals the number entering persons. Conversely, when a signal from the area of intersection E2 preceeds a signal from the area of intersection E1, an ordering circuit 11 generates a counting pulse and this pulse is counted by counter 12 which counts the number of exiting persons. Furthermore, the apparatus of FIG. 3 includes a power amplifier 8 an oscillator 10 and a devise 9 which counts the signals generated by the oscillator 10 and produces synchronizing signals.

In the embodiments illustrated above this embodiment of the present invention was described in terms of its application to entrances just wide enough for one adult person to pass through at a time. This was done in order to facilitate an understanding of the invention. However, it would also be possible to install a multiple number of pairs of radiant energy emitters and receivers A and B side by side in accordance with the width of the entrance so that a multiple number of areas of intersection E are formed. In such a situation, the distance between the approximate areas of intersection E is set at approximately 40 cm. If the adjacent areas of intersection E are positioned approximately 40 cm apart, an adult person passing through even a broad entrance would always pass through one area of intersection E. Therefore, no passing adult person will be erroneously emitted from the count. Furthermore, in cases where the pairs of radiant energy emitters and receivers A and B are installed in two rows so that two rows of intersection E are formed in order to count both entering persons and exiting persons, an interval of 10 to 15 cm between the two rows of areas of intersection E is appropriate. Furthermore, a vertical length of approximately 60 cm and a horizontal width of approximately 3 cm are appropriate for each area of intersection E. Areas of intersection of this size are sufficiently able to cover any height differences between adults. Furthermore, the use of radiant energy emitters and receivers A and B whose orientations can be adjusted facilitates the setting of each area of intersection E in the desired position and would also facilitate the adjustment of the size of each area of intersection E.

Figure 4:
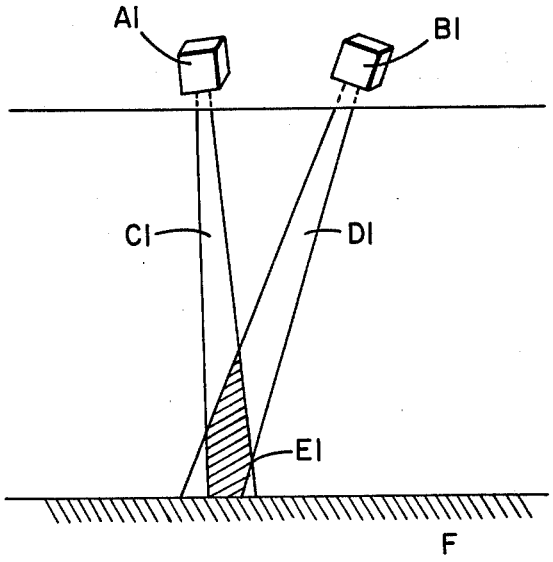
FIG. 4 illustrates the arrangement of a radiant energy emitter and a radiant energy receiver in a second embodiment of the present invention for use in building entrances with one-way traffic.

Referring to FIG. 4, shown therein is a basic arrangement of a single pair of radiant energy emitters and receivers utilized in a second embodiment of the present invention. In FIG. 4, the pair of radiant energy emitter and receiver includes a radiant energy emitter A1 and a radiant energy receiver B1 which are mounted in the ceiling above a floor F. The emitter and receiver A1 and B1 are installed over a building entrance which is wide enough for one adult person to pass through at a time. Furthermore, the emitter and receiver A1 and B1 are again installed so that the emitter and receiver A1 and B1 face each other at an angle. As a result, the radiant energy beam C1 emitted by the emitter A1 intersects an extension D1 of the radiant energy reception path of the radiant energy receiver B1 so that an area of intersection E1 is formed. The angle between the emitter A1 and the receiver B1 is adjusted so that the lower end of the area of intersection E1 reaches the floor and so that the upper end of the area of intersection E1 is some predetermined distance above the floor F. Typically this distance is a 120 cm.

Since a portion of the floor F is included in the area of intersection E1, a radiant energy loop is formed between the emitter A1 and the receiver B1. When one adult person reaches the apex of the area of intersection E1, either the beam C1 emitted by the emitter A1, the extension D1 of the receiver B1 or both are blocked by the head or shoulders of an adult person. As a result, the light loop is interrupted and the passing of one person is counted. Furthermore, when a child with a body height of 100 cm or less reaches the area of intersection E1, the head and shoulders of the child are contained inside the area of intersection E1 so that they do not reach the apex of the area of intersection E1. Therefore, the continuity of the light loop is maintained and the child is not counted.

In this embodiment both entering and exiting persons would be counted without any distinction being made between the two categories of counting persons. Accordingly, such a method would be appropriate for use in the case of entrances through which traffic passes in one direction only.

Figure 5:
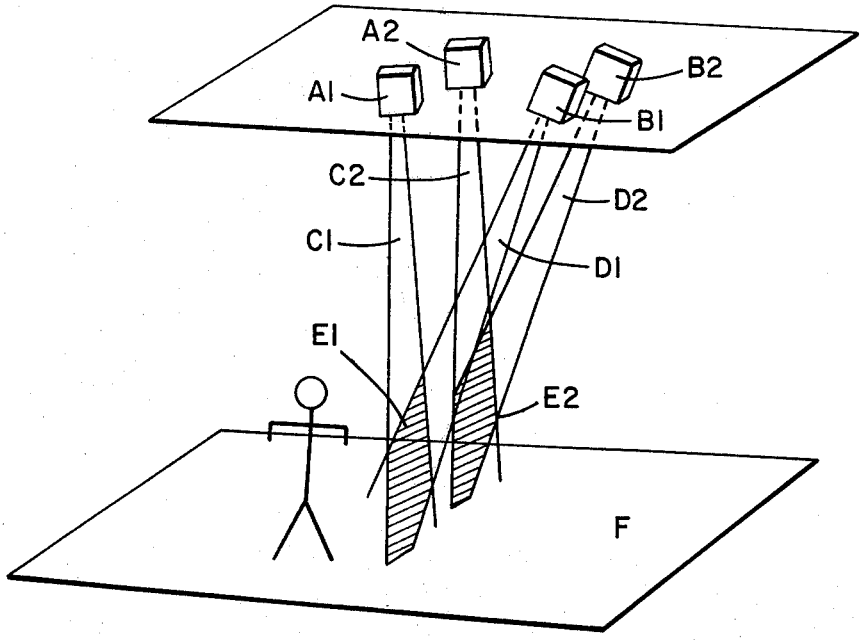
FIG. 5 illustrates installation of two pairs of radiant energy emitters and receivers in two rows in a second embodiment of the present invention for use in building entrances with two-way traffic.

Referring to FIG. 5, shown therein is a second embodiment of the present invention which includes a pair of emitters A1 and A2 and receivers B1 and B2. In the second embodiment, the beam C1 emitted by the emitter A1 and the beam C2 emitted by the emitter A2 intersects an extension of the reception path D1 of the receiver B1 and the extension of the reception path D2 of the receiver B2 at respective areas of intersection E1 and E2. In this arrangement, when one adult person passes through the area of intersection E2 after passing through the area of intersection E1, the person is counted as one entering person. On the other hand, when one adult person passes through the area of intersection E1 after passing through the area of intersection E2, the person is counted as an exiting person. Therefore, this apparatus would be appropriate for use in the case of entrances through which traffic passes in both directions.

Figure 6:
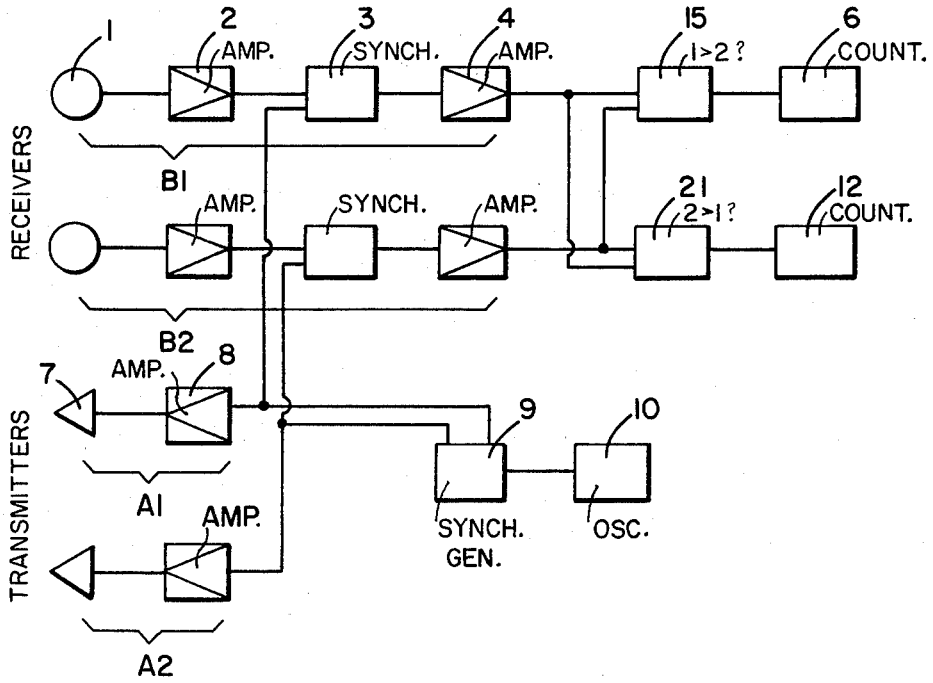
FIG. 6 is a block diagram which illustrates an apparatus for counting both entering and exiting persons using the radiant energy emitters and receivers shown in FIG. 5.

Referring to FIG. 6, shown therein is a block diagram of an apparatus for counting the respective numbers of entering and exiting persons utilizing the emitters and receivers of FIG. 5. In FIG. 6, the receiving element 1 shares an area of intersection E1 with an emitting element 7. When the radiant energy emitted by the emitting element 7 is reflected from the floor or when hand carried luggage or a child is present in the area of intersection E1, the radiant energy emitted by the emitting element 7 is detected as reflected rays by the receiving element and are amplified by the amplifier 2. Next, the product of the amplified rays and a synchronized signal added by a synchronizing detector 3 is obtained and only the synchronized component of the product is extracted as an output. This output is then amplified by amplifier 4. The amplified output constitutes a signal which indicates the area of intersection E1 is not being blocked by the head or shoulders of an adult person. When the signal from the areas of intersection E1 and E2 are interrupted and the interruption of the signal from the area of intersection E1 preceeds the interruption of the signal from the area of intersection E2, an ordering circuit 15 generates a counting pulse and this counting pulse is counted by a counter 6 which counts the number of persons entering. The total number of pulses counted is equal to the number of entering persons. Conversely, when the signals from the area of intersection of E1 and E2 are interrupted and the interruption of the signal from the area of intersection E2 preceeds the interruption of the signal from the area of intersection E1, an ordering circuit 21 generates a counting pulse and this pulse is counted by a counter 12 which counts the number of exiting persons. The total number of such pulses counted is equal to the number of exiting persons. Furthermore, in FIG. 6, the apparatus includes a power amplifier 8, an oscillator 10 and a device 9 which counts the signals generated by the oscillator 10 and produces synchronizing signals.

In the second embodiment illustrated in the above described figures, the present invention was described in terms of its application to entrances just wide enough for one adult person to pass through at a time. This was done in order to facilitate the understanding of the second embodiment of the present invention. However, it would also be possible to install a multiple number of pairs of emitters and receivers A and B side by side in accordance with the entrance so that a multiple number of areas of intersection E are formed in each of the one or two rows across the width of the entrance. In such a case, the distance between the adjacent areas of intersection E in the same row should be set to approximately 40 cm. If the adjacent areas of intersection E are positioned approximately 40 cm apart, an adult person passing through even a broad entrance will always pass through one area of intersection E. Therefore, no passing adult person will be erroneously emitted from the count. Furthermore, in cases where the pairs of emitters A and B are installed in two rows so that two rows of areas of intersection E are formed in order to count both entering persons and exiting persons, an interval of 10 to 15 cm between the two rows of areas of intersection E is appropriate. Furthermore, a vertical length of approximately 120 cm from upper end to the floor and a horizontal width of approximately 3 cm are appropriate for each area of intersection E. Areas of intersection of this size will be sufficiently able to cover any height differences between adults. Furthermore, in addition to infrared, visible light, and electromagnetic waves, ultrasonic emitters and receivers could be used in the present invention.

With the present invention described above, it is possible to accurately fix the distance between the detector and the object to be detected so that the detector does not react to the passing of persons or objects at a distance other than the fixed distance. Accordingly, this invention discriminates between different body heights. Specifically, only adult persons are counted by this invention. Children, hand carried luggage, pushcarts, etc., are excluded from the count. As a result, this invention possesses the advantage of high precision in counting what it is intended to count, i.e., passing adult persons. Furthermore, with these embodiments of the present invention, it is possible to count both entering and exiting persons. Therefore, this invention possesses the additional advantage of making it possible to determine the number of persons who have exited from the number of persons who have entered.

It should be apparent to those skilled in the art that the above described embodiments are merely illustrative of but a few of the many possible specific embodiments which represent the applications of the principles of the present invention. Numerous and varied other arrangements can be readily devised by those skilled in the art without departing from the spirit and scope of the invention.

I claim:

1. An apparatus for counting the number of persons passing a given point comprising:

at least one radiant energy emitter and at least one corresponding radiant energy receiver provided on a ceiling above said given point, said radiant energy receiver being provided at an angle to said radiant energy emitter and being arranged and configured together with said radiant energy emitter such that the radiant energy emitted by said radiant energy emitter only intersects an extension of a radiant energy reception path of said radiant energy receiver in an area of intersection having a low point located at a height corresponding to substantially the minimum height of a person to be counted whereby said radiant energy receiver receives radiant energy only while a person to be counted is passing through the area of intersection and said radiant energy emitted by said radiant energy emitter is reflect from a head or shoulders of said person to be counted;

means for generating a signal corresponding to the reception of said reflected radiant energy; and a means coupled to said receiver for counting said signals.

2. An apparatus according to claim 1 comprising a plurality of emitters and receivers arranged in pairs in two rows with a pair in each row provided along a line of movement of persons passing to form a first and second area of intersection along said line of movement and a means for determining if a person passes through said first area of intersection first before passing through said second area of intersection or if a person passes through said second area of intersection before passing through said first area of intersection and said counting means is responsive to said determining means whereby an accurate count can be made of persons passing in either direction through said first and second areas of intersection.

3. An apparatus according to claim 1 further comprising a plurality of emitters and receivers arranged in pairs in two rows with a pair provided in each row along a line of movement of persons passing and forming a first and a second area of intersection along said area of intersection and a means coupled to said receivers for determining if a person passes through said first area or said second area first and said counting means is responsive to said determining means whereby an accurate count of persons passing in either direction through said first and second areas of intersection can be made.

* * * * *